US006441284B1

(12) United States Patent
Greene

(10) Patent No.: US 6,441,284 B1
(45) Date of Patent: Aug. 27, 2002

(54) VERTICAL DRAFT RANDOM CHIMING MECHANISM

(76) Inventor: Roger L. Greene, 5920 Pinon Valley Rd., Colorado Springs, CO (US) 80919

( * ) Notice: Subject to any disclaimer, the term of this patent is extended or adjusted under 35 U.S.C. 154(b) by 0 days.

(21) Appl. No.: 09/878,510

(22) Filed: Jun. 11, 2001

(51) Int. Cl.[7] ..... G10D 13/08

(52) U.S. Cl. ..... 84/402; 84/403; 84/404; 84/405

(58) Field of Search ..... 340/392.1, 392.2, 340/393.1, 393.2; 84/402, 403, 404, 405

(56) References Cited

U.S. PATENT DOCUMENTS

| | | | | | |
|---|---|---|---|---|---|
| 4,854,214 | A | | 8/1989 | Lowe | 84/404 |
| 5,072,208 | A | | 12/1991 | Christensen | 340/392.4 |
| 5,208,578 | A | | 5/1993 | Tury | 340/392.2 |
| 5,369,391 | A | | 11/1994 | Gadsby | 340/392.5 |
| D370,183 | S | | 5/1996 | Christensen | D10/118 |
| 5,648,624 | A | * | 7/1997 | Smith | 84/404 |
| 5,831,516 | A | | 11/1998 | Jennings | 340/392.4 |
| 5,980,056 | A | | 11/1999 | West | 362/86 |
| 6,124,539 | A | | 9/2000 | Barnes | 84/402 |
| 6,124,782 | A | * | 9/2000 | Kraft, Sr. | 340/393.2 |
| 6,166,310 | A | | 12/2000 | Center | 84/402 |

OTHER PUBLICATIONS www.windlesswindchimes.com www.yahoo.com www-.windchimealley.com.*

* cited by examiner

*Primary Examiner*—Robert E. Nappi
*Assistant Examiner*—Kim Lockett

(57) ABSTRACT

A powered random chiming mechanism, related to the traditional outdoor wind chime that includes a body (10) by which a pendulum (20) is suspended centrally to a plurality of chimes (11*a*). A fan (14), integral to the device, generates a vertically rising column of air that emits from a point beneath the center rest position of the pendulum. A concave sail (20*c*) at the termination of the pendulum is then agitated, pulling the pendulum into random lateral motion. A striker (20*a*) located along the pendulum axis impacts the surrounding chimes to create tones of random sequence and degree for the purpose of enjoyment.

7 Claims, 12 Drawing Sheets

VERTICAL DRAFT RANDOM CHIMING MECHANISM

CROSS-REFERENCE TO RELATED APPLICATIONS

Not applicable.

BACKGROUND—FIELD OF INVENTION

This invention relates to wind chimes, specifically for a powered application.

BACKGROUND—DESCRIPTION OF PRIOR ART

Wind chimes are typically an ornamental outdoor accessory designed to produce pleasant tones during periods of moderately breezy weather. As a result, the tonal qualities of wind chimes are completely reliant upon a narrow range of meteorological conditions. The musical qualities of chimes are capricious in nature as well as limited to the out-of-doors. They cannot be enjoyed at the will of the listener.

Efforts to overcome the out-of-doors, seasonal and meteorological limitations inherent to the typical wind chime have resulted in several patents for both indoor and outdoor mechanically or electrically driven chiming devices. While the prior art devices cited may also be unwieldy, require expensive components or are unduly complex, their most critical failure is that of randomness. These attempts address functionality to some extent but do not adequately attend to a genuine random sequence and differentiation of impact in the creation of tones.

U.S. Pat. No. 5,208,578, to Tury (1993), consists of a solar collector and a multitude of electronics, all of which rotate a striker suspended from a motor shaft into a series of collisions with a set of chimes. This device requires light for power, rendering it useless in dim light and darkness. The rotary action of the striker necessarily assumes a sequential pattern of impacts. The only random element is the potential of a fluctuating light source. A desktop model of a photoelectric chime is manufactured by Solar. This is a miniature device with pencil-like chimes.

A patent to Barnes, U.S. Pat. No. 6,124,539 (2000), utilizes two huge magnets that move in symphony on either side of a wall or other barrier to replicate the impetus from a sail to an inner unit comprising a striker and chimes. This device is limited by a semi-permanent installation, inability to control the device, and favorable meteorological conditions.

The Electromechanical chime to Jennings, U.S. Pat. No. 5,831,516 (1997) employs an electric motor in the striking assembly with a weighted eccentric rotor. When under power, the pendulum adopts a linear back and forth motion that collides with the chiming members. This device does not attempt an equally random lateral motion whereby all chimes are equally susceptible to impact. It is therefore repetitious.

A water activated chiming device by Carter, U.S. Pat. No. 6,166,310 (1999), utilizes a collection basin and pump to impel water up a pipe in a helical motion where it then overflows back into the basin to agitate a float to provoke motion of the striker assembly. This apparatus will require and be limited to corrosion-resistant parts and surfaces, as well as watertight construction. It will also necessitate maintenance to fill and clean the reservoir.

The electromechanical chaotic chiming device to Christensen, U.S. Pat. No. 5,072,208 (1990), employs an electromagnetic drive assembly. When current is pulsed to the electromagnet, a pendulum with a permanent magnet is repelled into a single plane of motion. This device requires the impacted chimes to sway into the pendulum path to divert the natural linear state of motion into a chaotic state. Impacts created by this device would necessarily be abrupt and substantial, rendering it incapable of producing the more pleasurable gentle tones of chimes. A device of similar operation manufactured by Windless Windchimes is an expensive, stark, battery-powered desktop application with a computerized timing circuit. A side note of possible relevance, Christiansen was subsequently granted a design patent, U.S. D0332,924 (1996), on a simple indoor wooden chime stand that is not animated.

To summarize, many garden centers and gift shops display lifeless racks of variations on the typical outdoor wind chime. The meager showing of indoor chimes would suggest that these prior attempts remain either unmarketable or unsatisfactory to some extent.

SUMMARY

The chiming apparatus of the present invention manufactures and directs an air current upward at the center rest position of a pendulum equipped with a horizontally oriented concave sail at the termination. The resulting interaction causes a random lateral motion of the pendulum. A striking member integral to the pendulum assembly then impacts the surrounding resonating elements with varying degrees of force and in corresponding random motion of the sail. This produces an endless variation of tones by degree and sequence that is interesting and pleasant to hear.

OBJECTS AND ADVANTAGES

Accordingly, besides the objects and advantages of the vertical draft random chiming mechanism described in my above patent, several other objects and advantages of the present invention are:

(a) to provide a pleasant and unique effect of wind chime tones in settings not normally associated with chimes.

(b) to provide an aesthetically appealing and unique form of cabinetry, sculpture or decoration that is a functional chiming device.

(c) to:provide a point of visual interest by the physical action of the members.

(d) to provide a simple and free-acting mode of operation that compliments the general theme of a wind chime.

(e) to provide a light and easily portable chiming device.

(f) to provide a chiming device that lends itself to a myriad of embodiments to suit different tastes and styles.

(g) to provide a chiming device suitable for a variety of useful applications.

(h) to provide a chiming device with additional useful characteristics.

(i) to provide a chiming device that can utilize fine craftsmanship, detail, and materials.

(j) to provide a chiming device that functions with a wide spectrum of chime configurations and materials.

(k) to provide a chiming device that remains functional without current if exposed to cross-directional airflows.

(l) to provide a chiming device that utilizes inexpensive and readily available components. Further objects and advantages will become apparent from a consideration of the ensuing description and drawings.

DRAWING FIGURES

In the drawings, closely related figures have the same number but different alphabetic suffixes.

REFERENCE NUMERALS IN DRAWINGS

Figure 1:
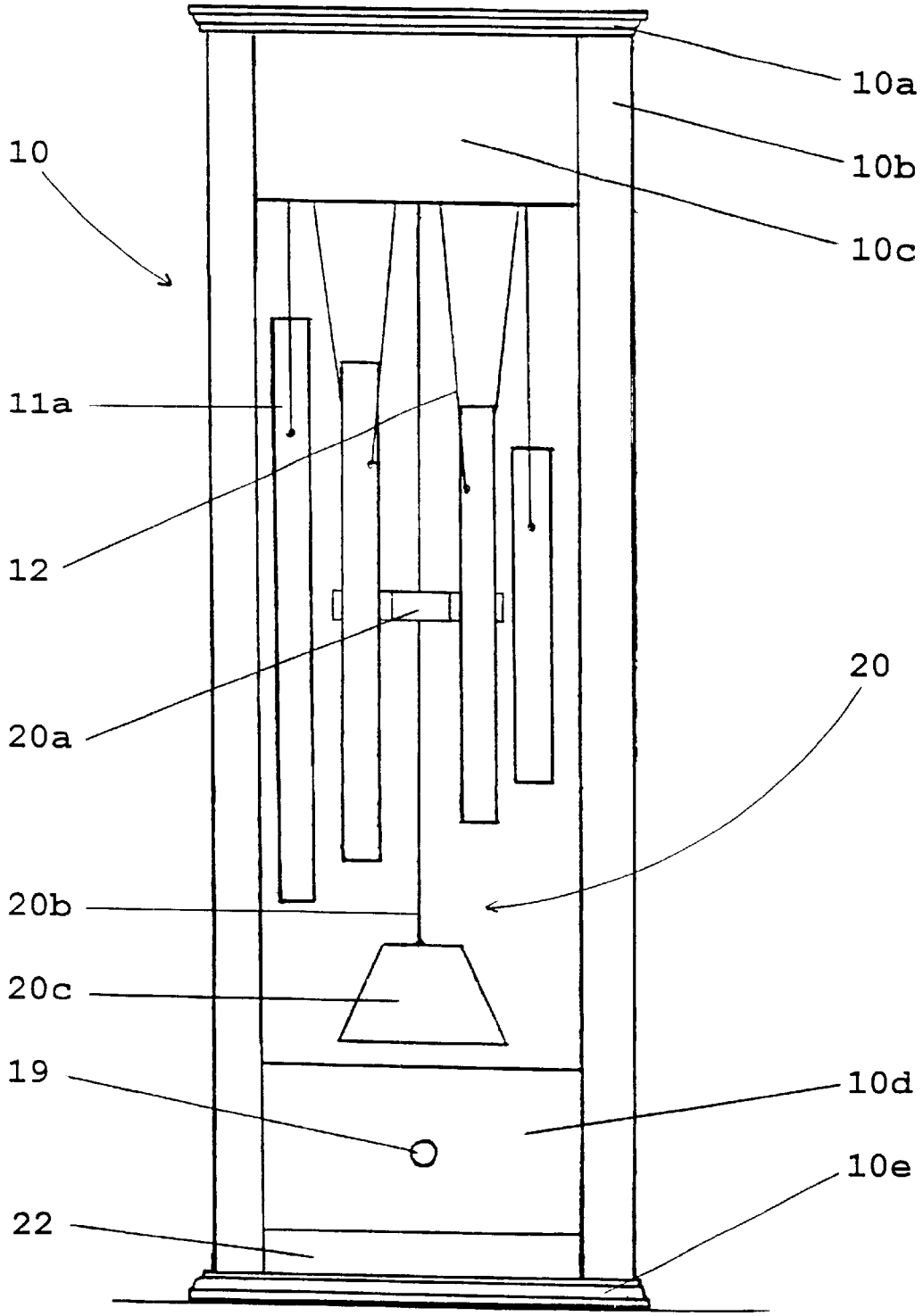
FIG. 1 shows a front view of the preferred embodiment.
Figure 2:
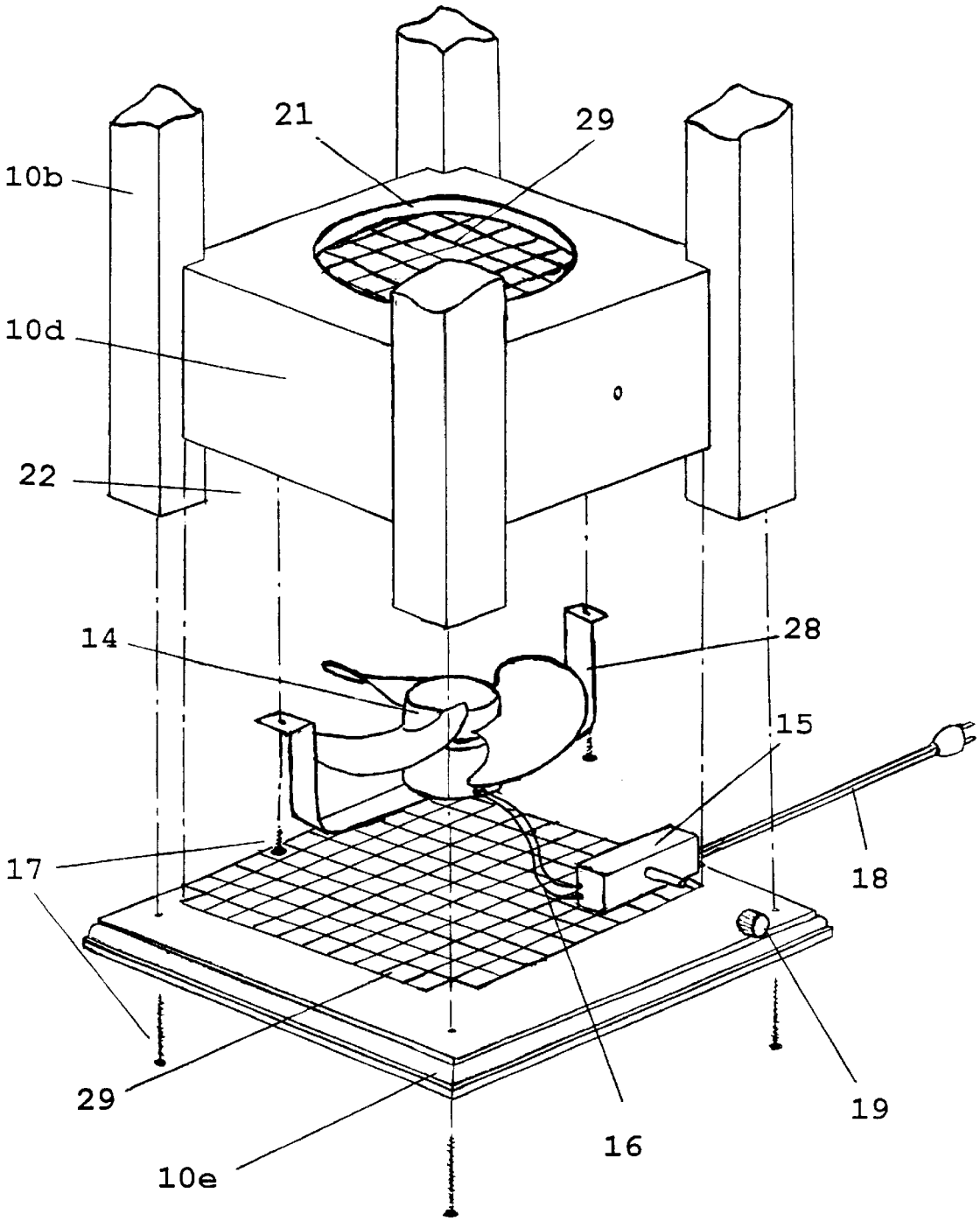
FIG. 2 is a blown-apart view detailing the fan and electrical control of the preferred embodiment.
Figure 3:
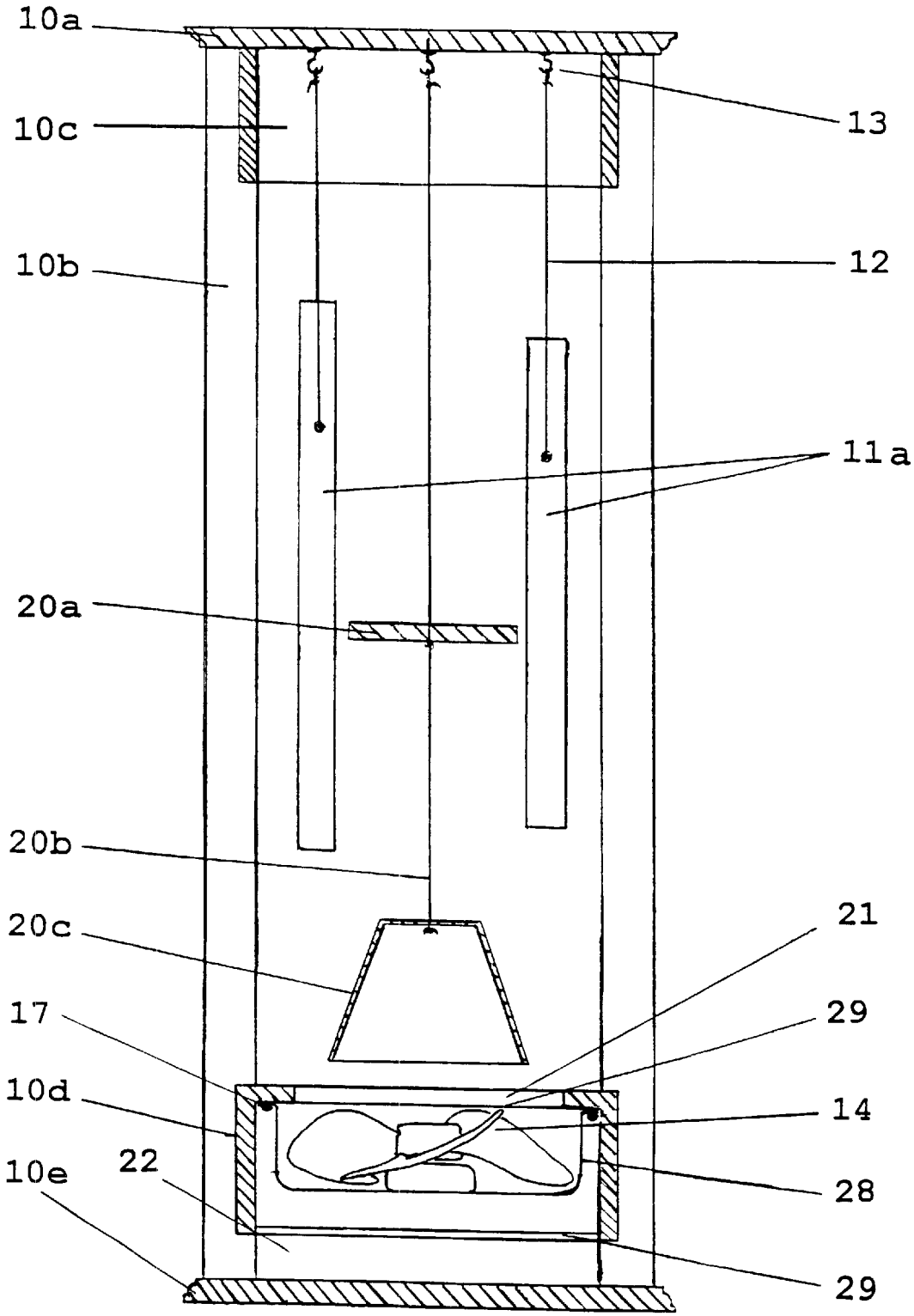
FIG. 3 is a cross-section view of the preferred embodiment.

10 body
10*a* top plate
10*b* baluster uprights
10*c* valance
10*d* square fan case
10*e* bottom plate
10*f* cantilevered uprights
10*g* rod uprights
10*h* panel enclosure
10*i* round fan case
10*j* hexagon fan case
11*a* tubular chimes
11*b* cupped chimes
11*c* plate bell
11*d* cast bell
11*e* solid rod chime
11*f* ring chimes
12 suspension cord striker
13 hooks
14 fan
15 electrical control
16 internal wiring
17 screws
18 electrical supply cord
19 control knob
20 pendulum assembly
20*a* striker
20*b* axis cord
20*c* sail
21 output aperture
22 intake gap
23 pin
24 scent holder
25 timer control
26 flood bulb
27 lamp socket
28 support bracket
29 fan guard
30 in-line switch
31 duct-work
32 medallions
33 thematic multi-part striker Description—FIGS. 1, 2, & 3—Preferred Embodiment The preferred embodiment of the present invention is illustrated in FIG. 1, a front view. Body 10 supports and keeps all the elements in proper alignment and proximity to each other. The under surface of top plate 10*a* serves as a point of attachment for tubular chimes 11*a* and pendulum assembly 20. Baluster uprights 10*b* support top plate 10*a* and are stabilized by valance 10*c*. Square fan case 10*d* is also supported by baluster uprights 10*b* and mounted above bottom plate 10*e* in such manner as to allow intake gap 22. Fan case 10*d* (FIGS. 2 & 3) has output aperture 21 directly above fan 14.

Tubular chimes 11*a* (FIGS. 1 & 3) are depicted as a typical metal variety. FIG. 3 shows only two chime tubes in full for clarity. Chimes 11*a* hangs by means of suspension cord 12 strung through holes in chimes 11*a*. Cord 12 attaches to top plate 10*a* by hooks 13. Suspended chimes 11*a* encircle pendulum assembly 20 in equal proximity to the central axis of the pendulum assembly.

Pendulum assembly 20 (FIG. 3) hangs by means of axis cord 20*b* from top plate 10*a* by hook 13. Striker 20*a* is located at a midpoint along axis cord 20*b*. Striker 20*a* has a faceted circumference in this embodiment. Pendulum assembly 20 terminates with sail 20*c*. The central axis of pendulum assembly 20 aligns with the center of output aperture 21 in fan case 10*d*. Sail 20*c* is a concave cup design open on the bottom and closed at the top.

FIG. 2 is a blown apart view of the fan case. The case encloses fan 14, internal wiring 16, and electrical control 15. Fan guard 29 covers aperture 21. Fan 14 affixes to support bracket 28, which affixes to fan case 10*d* by means of screws 17. Internal wiring 16 leads from electrical control 15 to fan 14. Electrical supply cord 18 extends from electrical control 15, and exits fan case 10*d*. Fan guard 29. covers the undersurface of the fan case. Bottom plate 10*e* attaches to baluster uprights 10*b* by means of screws 17. Control knob 19 slides over stem of electrical control 15.

Figure 4:
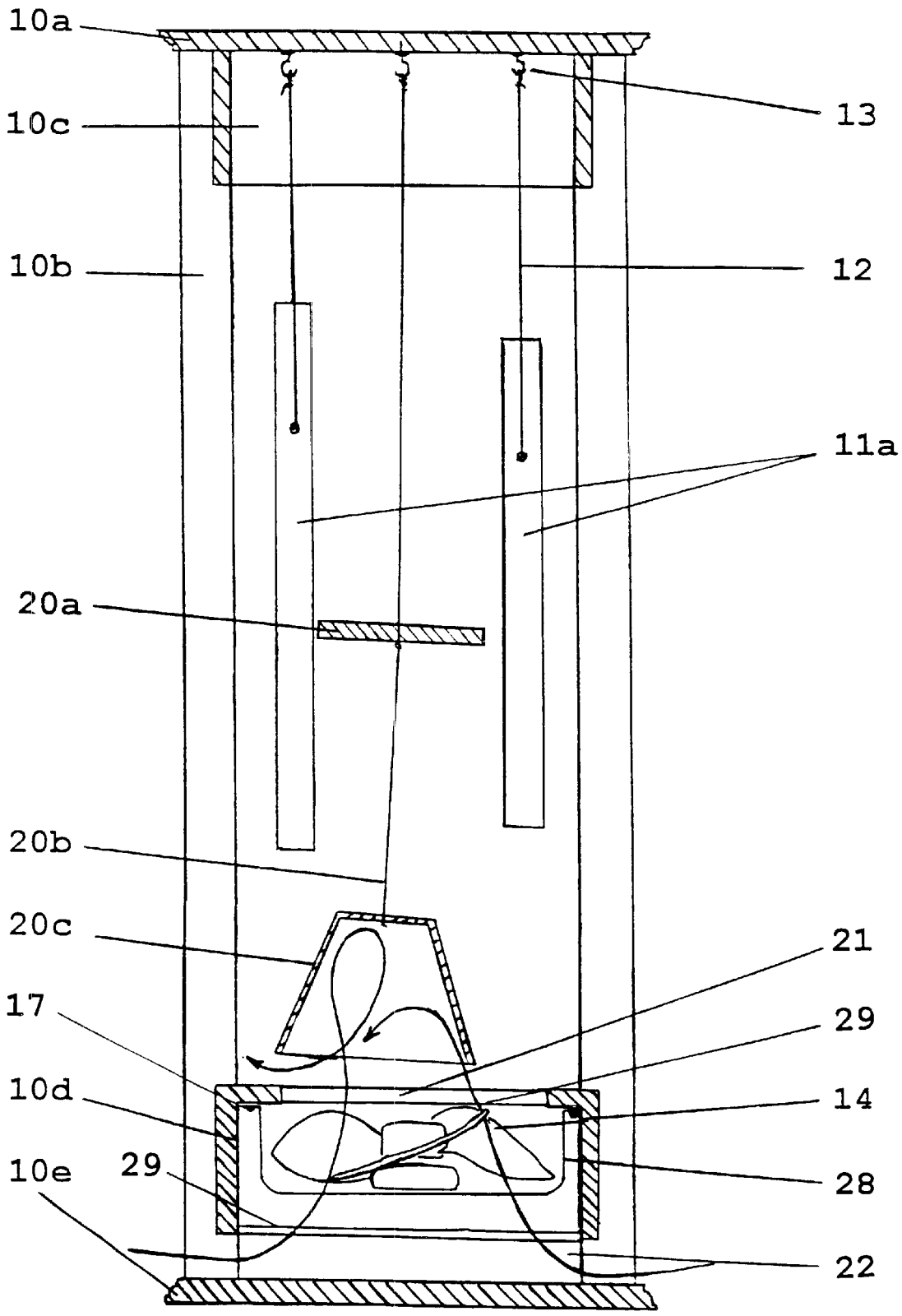
FIG. 4 is a cross-section view of the preferred embodiment depicting action and airflows of the device in operation.

Operation—FIGS. 2&4—Preferred Embodiment

Action of the members and airflows of the preferred embodiment of the vertical draft random chiming mechanism are represented in FIG. 4. FIG. 4 shows only two tubular chimes 11*a* for clarity.

Beginning with FIG. 2, electricity is conducted to electrical control 15 by electrical supply cord 18. A rheostat is the preferred embodiment of the electrical control. Satisfactory results for the operation of this device require that fan 14 operate well below its maximum capacity to minimize sound created by the generation of airflow. Control knob 19 allows the user to manage electrical control 15. Current proceeds from electrical control 15 through internal electrical wiring 16 to fan 14. Fan 14 is covered by protective guard 29 at aperture 21 and the bottom of fan case 10*d*.

Airflow, indicated by arrows in FIG. 4, is drawn into fan case 10*d* through intake gap 22 above bottom plate 10*e* by fan 14. Airflow proceeds through fan 14 and aperture 21 into sail 20*c*. The concave design of sail 20*c* catches the upward and vertical airflow at its center rest position. Sail 20*c* then accumulates air pressure adequate to initiate lateral motion from the center rest position.

Striker 20*a* is subsequently drawn into proportionate lateral motion by outward force exerted on vertical axis cord 20*b* by motion of sail 20*c*. Striker 20*a* then impacts tubular chimes 11*a*, inducing resonance in the chimes to produce tones. Sail 20*c* is drawn to a gravitational center rest position yet also continuously repelled from it by the vertical airflow emitting at its center. This results in a continual and random lateral motion of the pendulum and resulting variation of impacts with the chimes.

Pendulum axis cord 20*b* allows flexibility of the axis as well as a degree of rotation. Pendulum sail 20*c* tends to rotate and counter-rotate as it interacts with the airflow. The faceted circumference of striker 20*a* identified as the preferred embodiment, coupled with a degree of rotation in axis cord 20*b* enhances the random quality of the device. It effectively varies proximity of striker 20*a* to the chimes, altering impact and degree of impact with tubular chimes 11*a*.

Tubular chimes 11*a*, hung by suspension cord 12 also adopt a swaying motion as they are impacted. Their action is another random component that enhances the overall effectiveness of the device. Hooks 13 provide a quick and easy means of affixing or removing the chime and pendulum cords for handling.

Top plate 10*a* bears the weight of the pendulum and chime members. It is stabilized by valance 10*c* and supported by uprights 10*b*. The valance also serves to hide the hook and cord attachment. Fan 14 and bottom plate 10*e* are affixed by screws 17 (FIG. 2) for ease of removal.

My understanding of the actions of airflow, pressures, and release of pressures is rudimentary and may not be complete or accurate in terms of their actual physical properties or characteristics. They only serve as my best understanding regarding the operation of this device and I do not wish to be bound by them.

Figure 5:
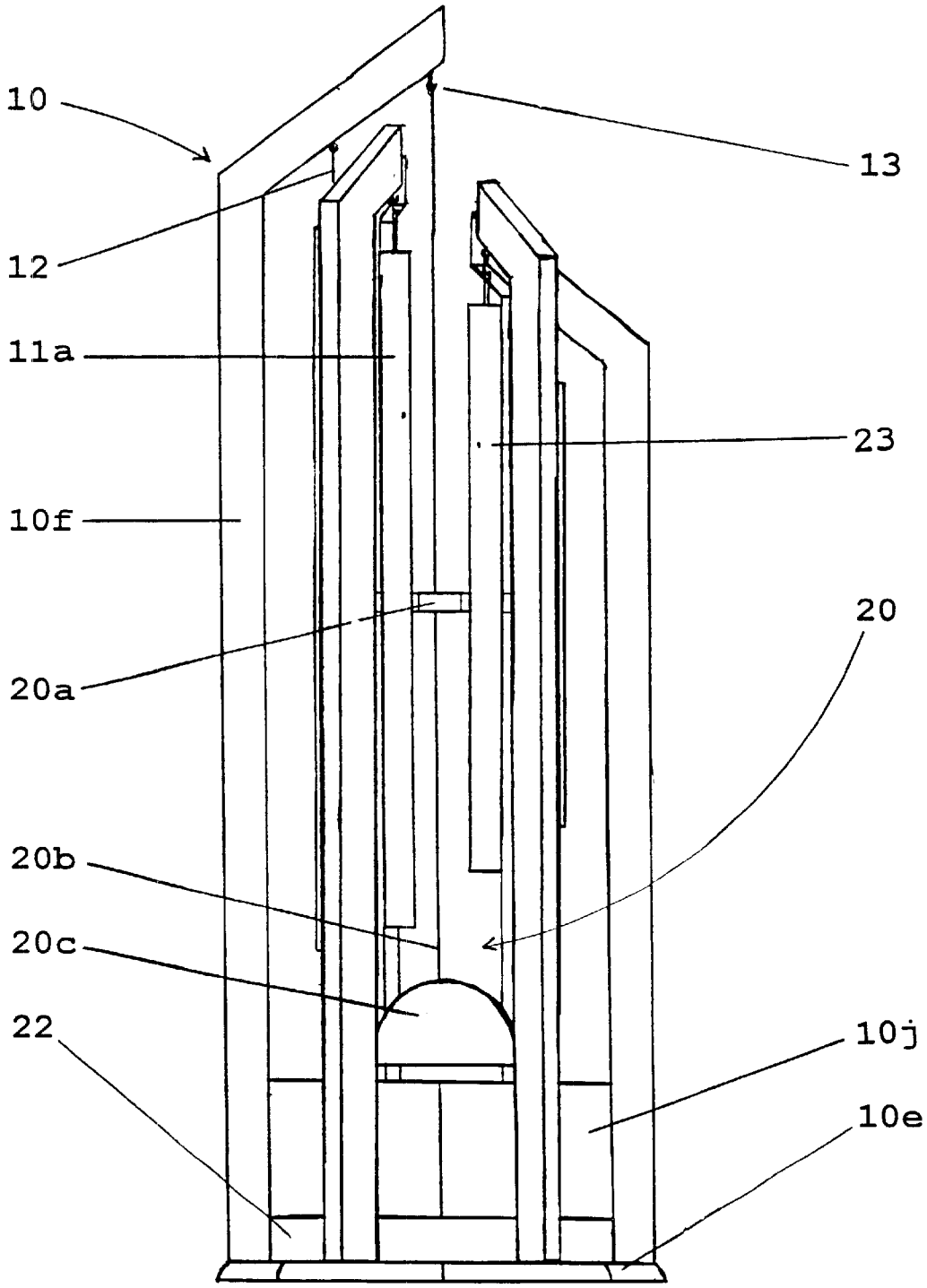
FIG. 5 is a side view of a first alternative embodiment with cantilevered support members.

Description—FIG. 5—First Alternative Embodiment

The first alternative embodiment is characterized by cantilevered upright members and a hexagonal fan case. Members of body 10 support and align the elements in proper relationship to one another. Six cantilevered uprights 10*f* of successive height connect bottom plate 10*e* to hexagon fan case 10*j* allowing intake gap 22. Hooks 13 affix on the cantilevered portion of the uprights. Suspension cord 12 hangs on hooks 13 and attaches to tubular chimes 11*a* by means of pin 23. Pendulum assembly 20 affixes to hook 13 on the uppermost cantilevered upright which extends over the central point of the body. Striker 20*a* is mounted at a midpoint on axis cord 20*b* which then terminates with sail 20*c* immediately over the center of aperture 21 in hexagon fan case 10*j*.

The internal components of fan case 10*j*, concealed in this side view are essentially the same as those depicted in FIG. 2 of the preferred embodiment.

Operation—FIG. 5—First Alternative Embodiment

Operation of the first alternative embodiment is the same as the preferred embodiment.

Figure 6A:
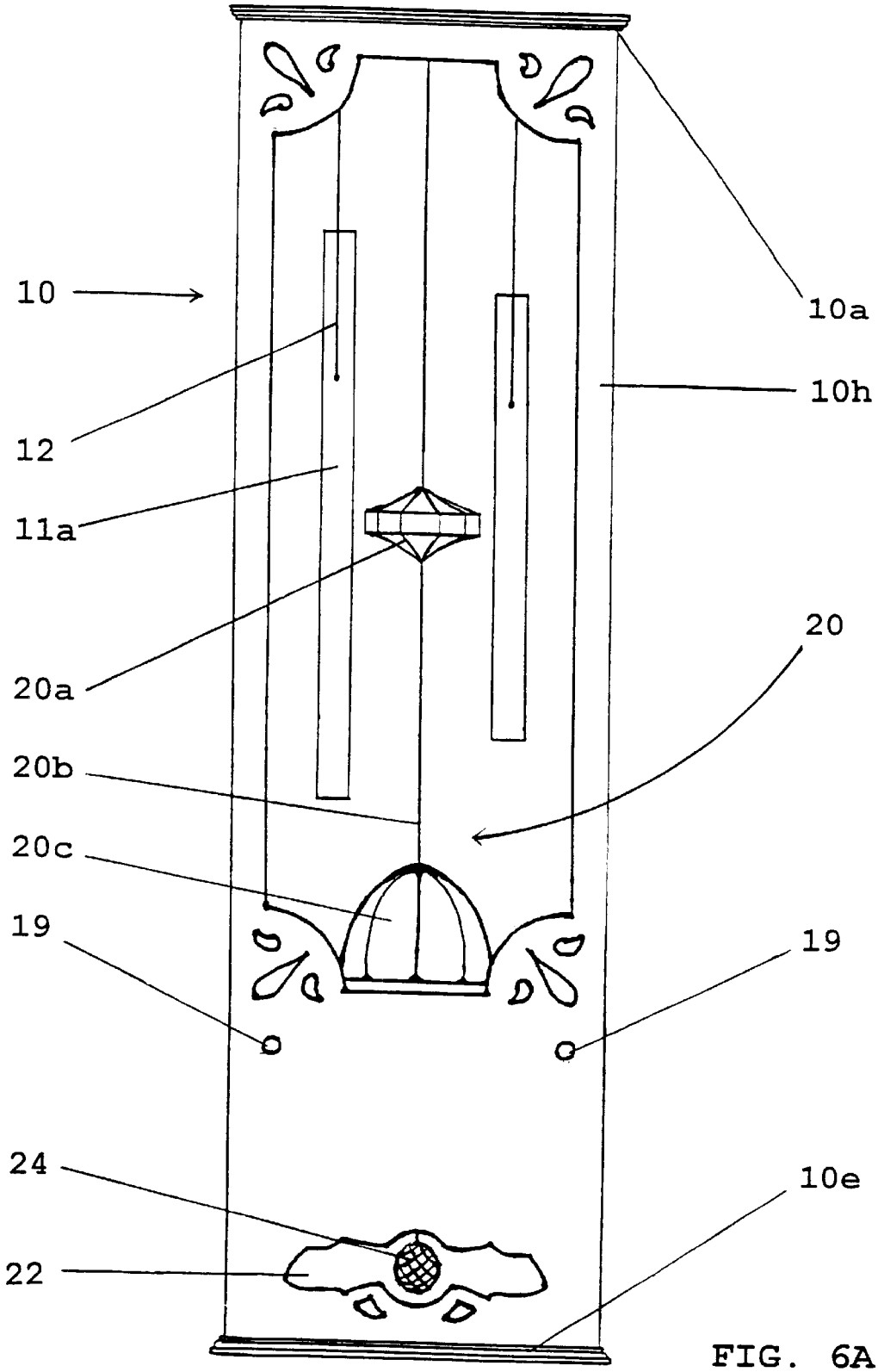
FIG. 6A is a front view of a second alternative embodiment wit panel side members.
Figure 6B:
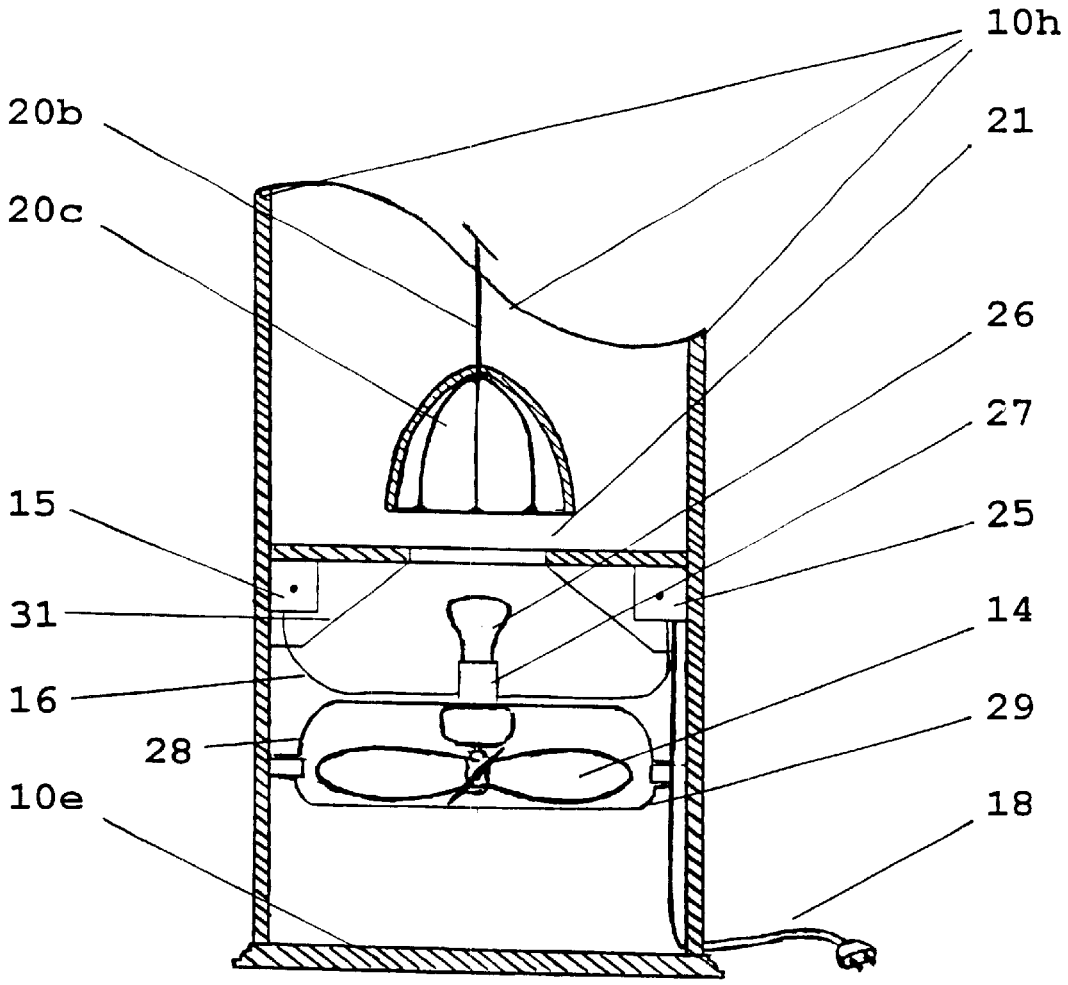
FIG. 6B is a cross section view of the second alternative embodiment.

Description—FIGS. 6A & 6B-Second Alternative Embodiment

FIG. 6A, the second alternative embodiment shows only two tubular chimes for clarity. Panel enclosure 10*h* unifies construction of body 10. Intake gap 22 is fashioned in panel enclosure 10*h* above bottom plate 10*e*. Wire mesh scent holder 24 hangs in intake gap 22. Two control knob 19's are located on the front panel. Pendulum 20 and chimes 11*a* are the same as the preferred embodiment.

FIG. 6B shows a cut-away view of the inner components. Lamp socket 27 mounts on support bracket 28 above fan 14. Flood bulb 26 inserts in socket 27. Ductwork 31 angles from fan 14 to output aperture 21. Timer control 25 mounts between electrical supply cord 18 and electrical control 15.

Operation FIGS. 6A & 6B

This embodiment adds two effects to the preferred embodiment. Both benefit from the additional useful characteristics inherent to the device's design. Scent holder 24 hangs in intake gap 22. The wire mesh egg-shaped holder opens. Scented agents such as oiled cloth are inserted. Air drawn through gap 22 by fan 14 picks up scent and disperses through output aperture 21 as a mode of aroma-therapy or for use as an air-freshening device.

Ductwork 31 restricts and guides airflow past lamp socket 27 and flood bulb 26. Heat generated by flood bulb 26 is dispersed by airflow during operation. Light beamed upward by bulb 26 shines into pendulum sail 20*c*. In this embodiment the sail may have a translucent construction. The kinetic characteristics of the pendulum and chimes then casts shadows and light to create a dancing effect on ceilings and walls.

Timer control 25 may be of any variety that augments enjoyment and usefulness of the device.

Figure 7:
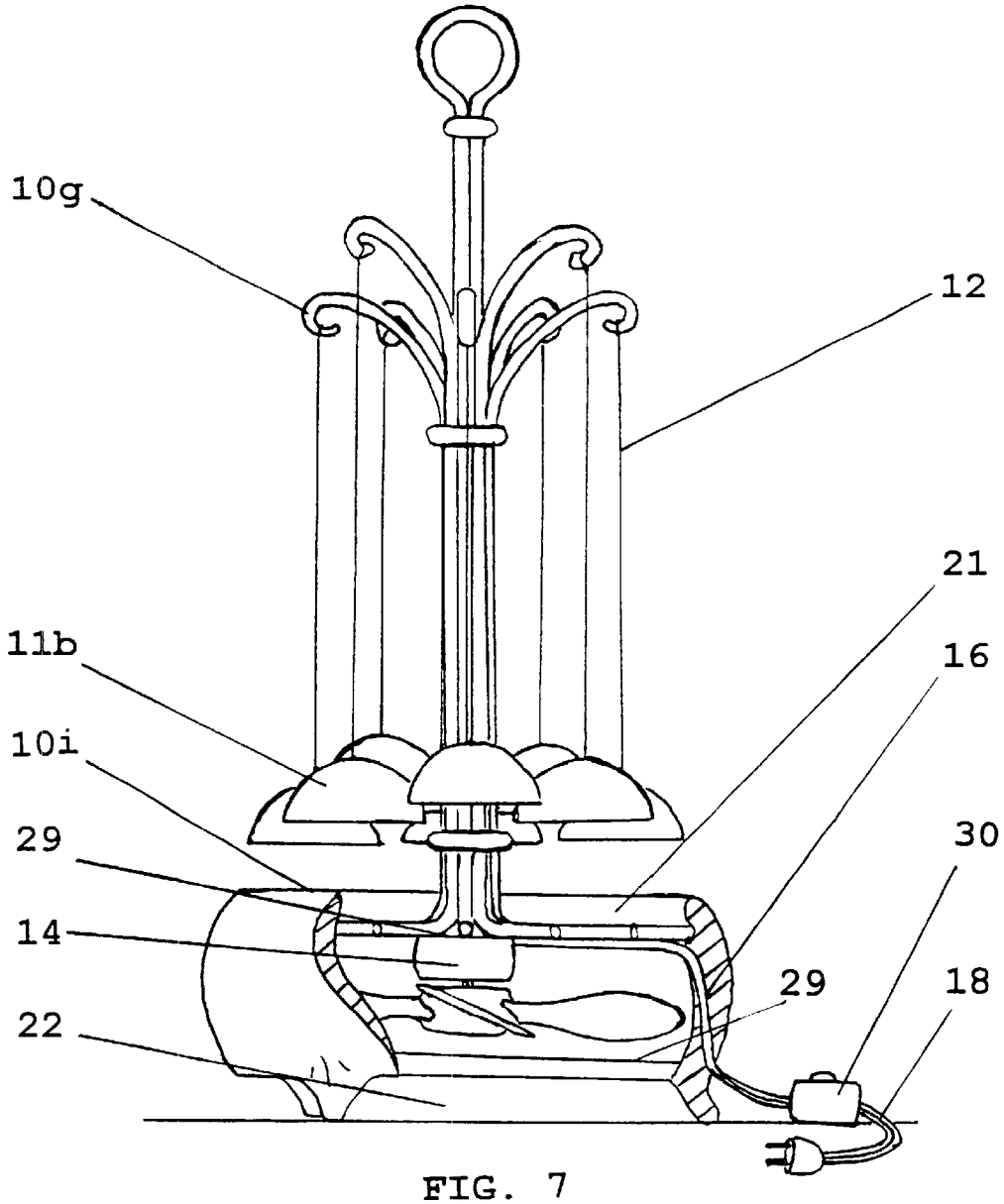
FIG. 7 is a side view of a third alternative embodiment of a round enclosure with a section cut away.

Description—FIG. 7—Third Alternative Embodiment

The embodiment depicted in FIG. 7 utilizes cupped chimes 11*b*. Air intake gap 22 comprises the underside space created by integral standoffs of round fan case 10*d*. Rod uprights 10*g* insert to fan case 10*d* in output aperture 21, bind together, rise up, then splay outward as support members for suspension cord 12 and cupped chimes 11*b*. The electrical control for this embodiment is in-line switch 30 located on electrical supply cord 18.

Operation—FIG. 7—Third Alternative Embodiment

In this embodiment, cupped chimes 11*b* interact with vertical airflow generated by fan 14. The individual chimes become animated by the airflow, performing with motion similar to the pendulum sail of previous embodiments. As they take on a random lateral motion, they begin to strike one another, thus inducing resonance in both members. In effect, this embodiment utilizes multiple resonating pendulums in the production of tones. The cupped chimes may be of dissimilar materials, size, and placement for variation of effect. Alternation of resonating and non-resonating cupped chimes or non-resonating cups acting on interspersed alternate chime configurations is also effective.

Figure 8A:
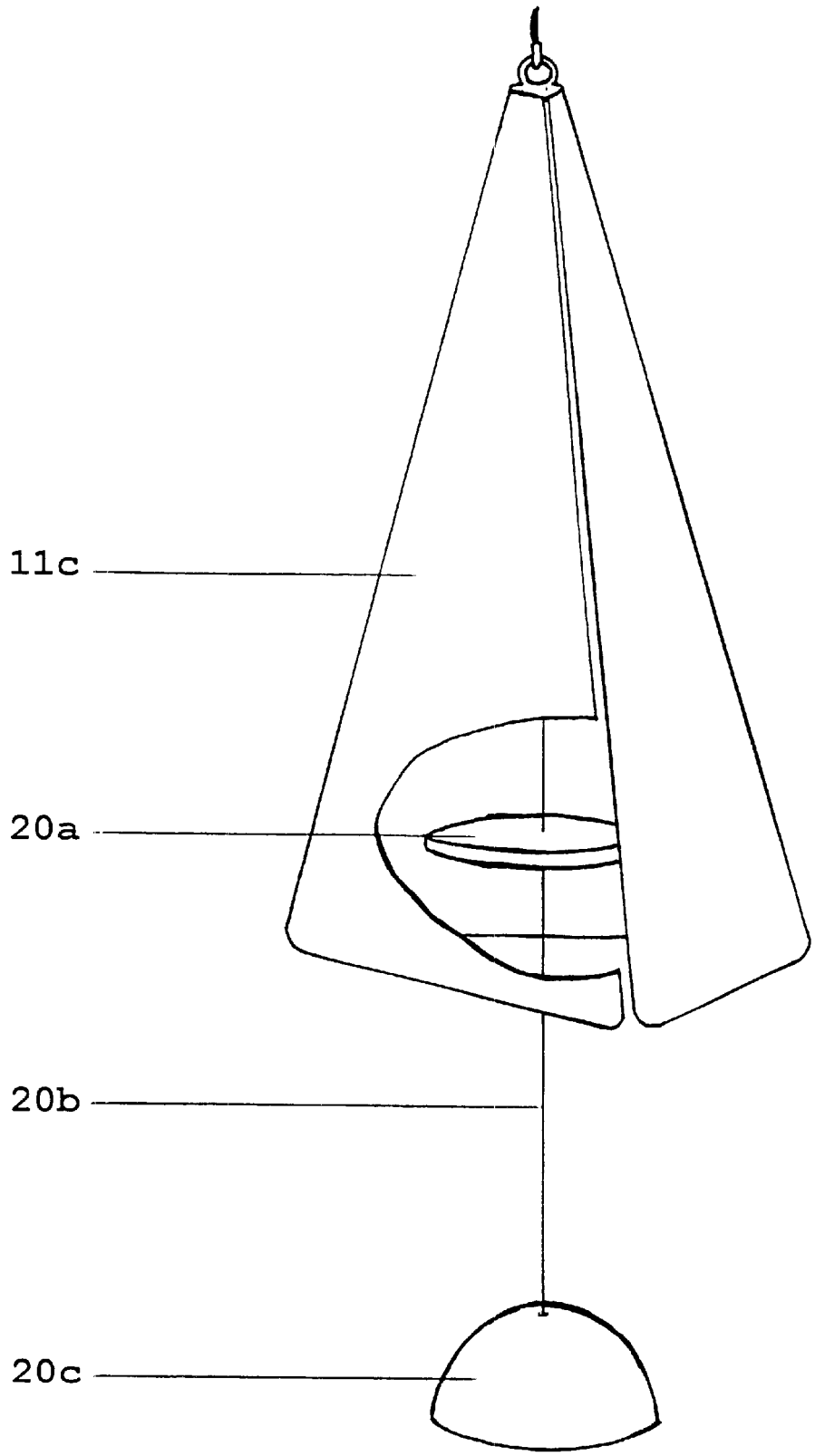
FIG. 8A is a side view of a plate bell embodiment with a section cut away.

Description—FIGS. 8A, B, C, &D—Additional Embodiments

Figure 8B:
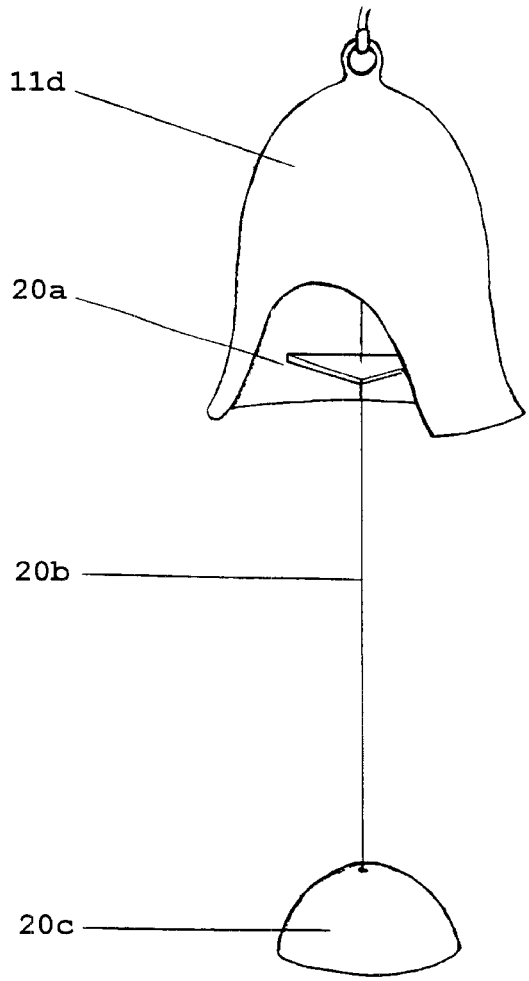
FIG. 8B is a side view of a cast bell embodiment.
Figure 8C:
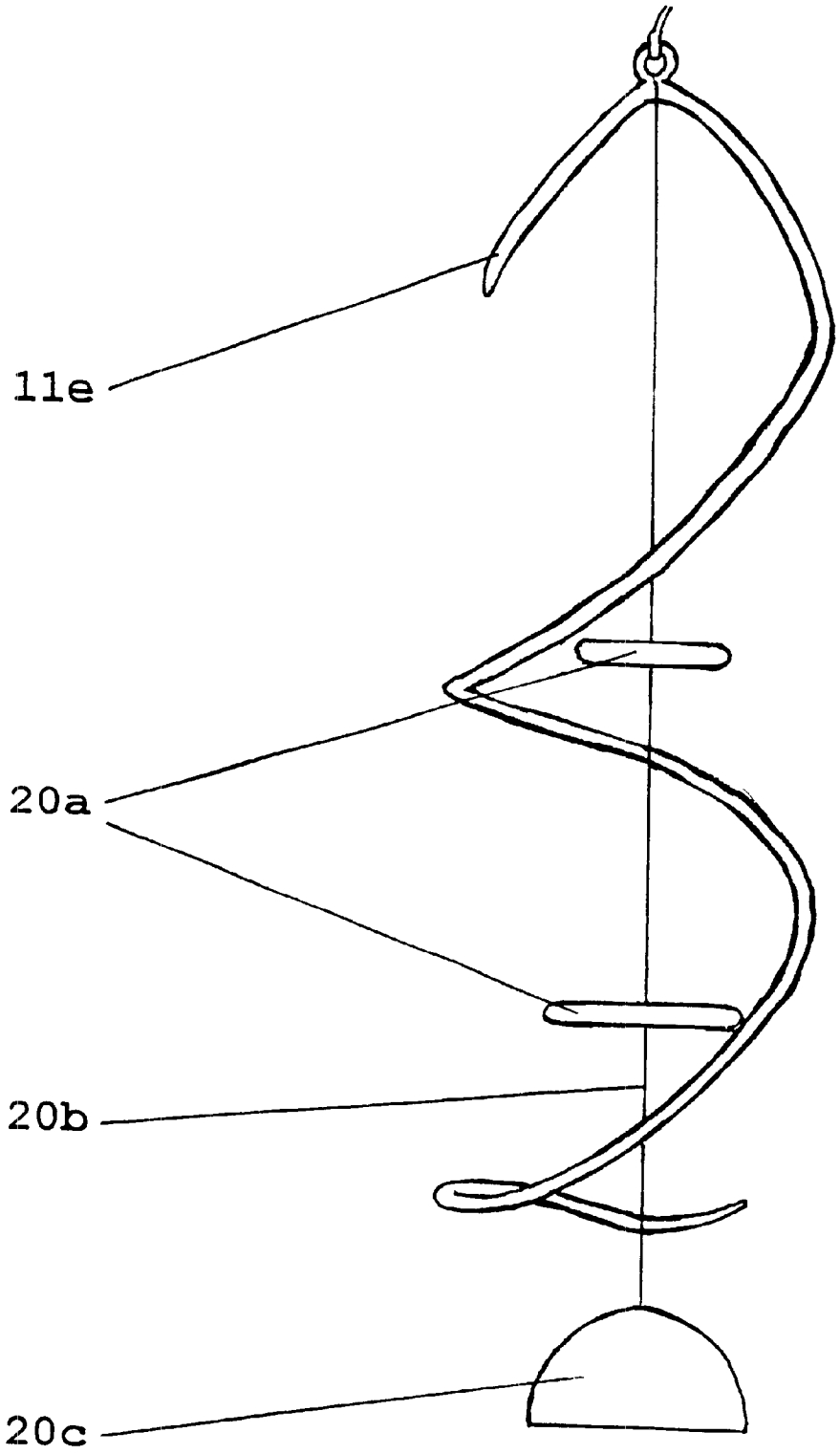
FIG. 8C is a side view of a solid rod chime embodiment.
Figure 8D:
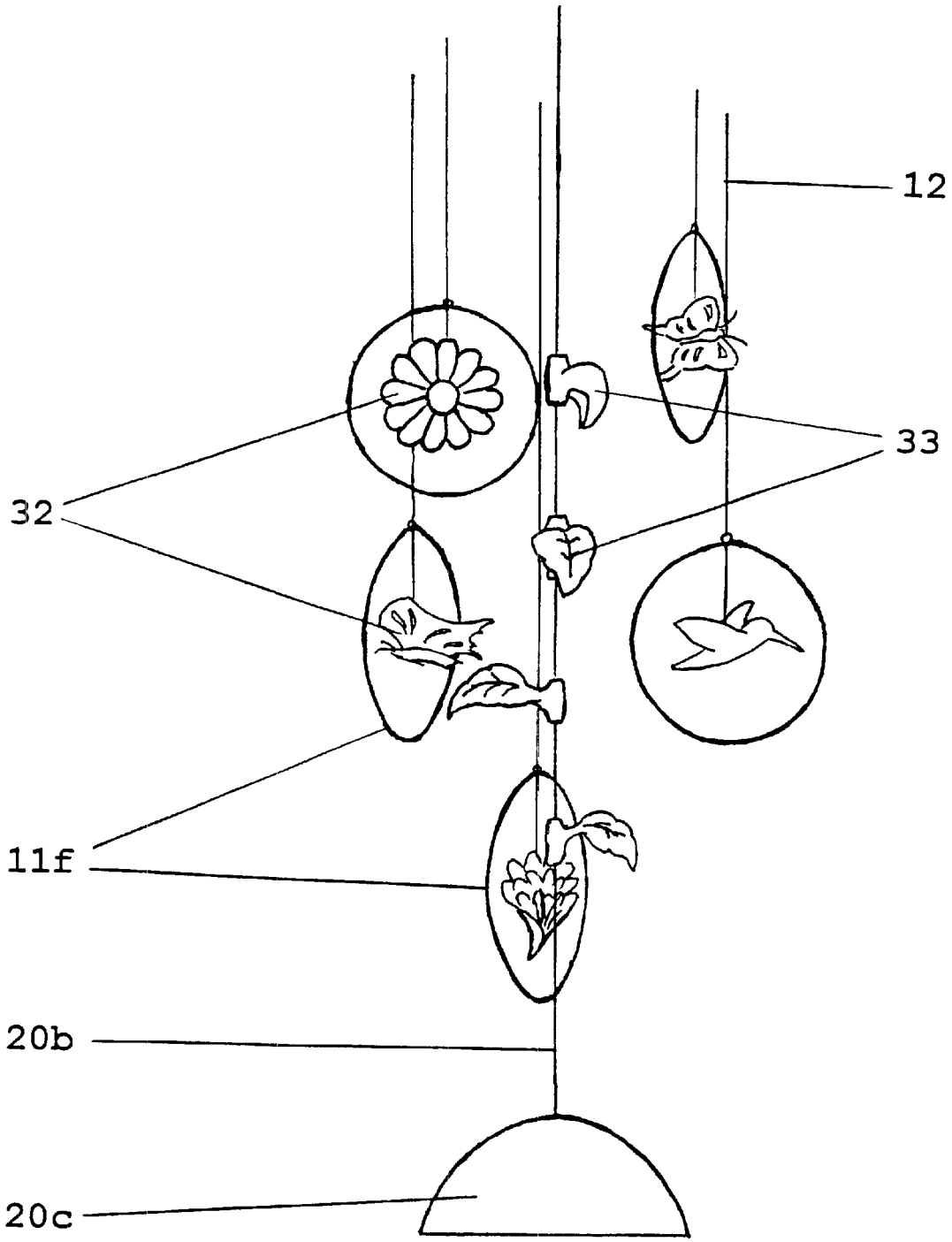
FIG. 8D is a side view of a ring chime embodiment with ornamental medallions and a multi-part striker.

FIGS. 8A, B, C, D depict variations of pendulum and chime configurations that are suitable for use with the vertical draft device. FIG. 8A is plate bell chime 11*c* cut away to show the pendulum. FIG. 8B is cast bell chime lid cut away to show the pendulum. FIG. 8C is a continuous solid rod chime 11*e* and pendulum with dual strikers 20*a*. FIG. 8D shows ring chimes 11*f* with decorative medallions 32 and a pendulum with thematic multi-part striker 33.

Operation—FIGS 8A, B, C, &D-Additional Embodiments

Plate bell chime 11*c* in FIG. A utilizes a multiplicity of plates welded together at a point. This comprises the resonating members acted upon on the pendulum assembly.

Cast bell chime 11*d* in FIG. B utilizes a unified casting as a single resonating member that is impacted by the pendulum assembly. A fingered or geometrically shaped striker is preferable for this embodiment. The pendulum may orbit the airflow and in so doing, effectively dampen resonance when a round striker is coupled with a round bell configuration.

Solid rod chime 11*e* encircles and extends along the length of the pendulum assembly in FIG. C. The pendulum utilizes two strikers 20*a,* to create variation of tone by striking different locations along solid rod chime 11*e*. Only one rod is depicted for clarity.

Ring chimes 11*f* in FIG. 8D are free hanging. The pendulum striker for this embodiment is multi-part, thematic striker 33. As previously noted, the pendulum assembly will take on a slight rotational motion as it sways. The individual strikers along the axis cord will rotate slightly in and out of range for striking a given ring. The rings will rotate from impacts and possibly from secondary or residual action of airflow as it acts upon center medallion 32. The configurations of elements in this embodiment compound randomness of operation resulting in a less dense tonal pattern. In this embodiment, the device is highly ornamented. The thematic striker, formed as leaves in this example, enhances a springtime garden theme as an example of design flexibility.

Conclusion, Ramification, and Scope

The advantages of the vertical draft random chiming mechanism are many. Due to the unique vertical application of airflow and the specially configured sail, this device is capable of producing tones of a truly random nature in both sequence and degree. Electrical operation brings the pleasure of wind chimes indoors and makes them fully controllable for enjoyment whenever desired. Inexpensive components and their wide availability provide a practical and affordable apparatus from a manufacturing and sales perspective. The simplicity of the device as well as its inherent features also lends itself to a wide degree of usage. The device is highly adaptable for motif and artistic interpretation of the elements.

Applications involving secondary usage include combination of a clock or timer to utilize the mechanism for use as a gentle wake-up, lullaby, or hourly chime. An intermittent timer provides a pleasing interlude throughout the day. Other electronic switches such as a motion sensor, photoelectric control, thermal switch, infrared remote or rheostat are possible alternatives to achieve desired effects.

Variations of design for the chiming mechanism are virtually limitless. Generated airflow can be ducted, baffled or vented to the sail as an alternative to the direct application of a fan. The mechanism can be adapted into many configurations including tabletop, freestanding, wall-mount, or suspended. Integration with lighting, cabinetry, furniture, sculpture, and natural materials are but a few of the expected applications.

Possible alternatives for composition of the device and its elements would again be virtually boundless. Metals, ceramics, woods, fabrics, membranes, glass, crystal, and plastics should be considered viable and likely in the course of manufacturing and artistic expression.

The chime and striking configurations set forth in the preferred and additional embodiments demonstrate but a few possible applications. Any resonating configuration and suitable means of attachment, coupled or integrated with a means of inducing impact should be considered an expected result of the invention.

Motion generated as an inherent feature of the device can be combined with lighting treatments to produce effects complimentary to the overall theme of relaxation and mood. Light reflection, refraction, projection, and kinetic effects are expected additional applications of this device.

Airflows generated as an inherent feature of the device may serve additional purpose to disperse scenting agents such as incense, scented oils, room deodorizers, and equivalents. Other secondary uses of the device's airflows may serve to ionize, purify, heat, cool, or otherwise treat air cycled by the device to serve an additional purpose.

Although the description above contains many specificities, these should not be construed as limiting the scope of the invention but as merely providing illustrations of some of the presently considered embodiments of the device. The scope of this invention should be determined by the appended claims and their legal equivalents, rather than by the examples given.

I claim:

1. A vertical draft random chiming mechanism to produce tones of random sequence and degree, comprising, at least one resonating means capable of producing a tone or sound when impacted, at least one striking means along the vertical axis of a free-hanging pendulum adjacent to said resonating means and within a proximity whereby impact can occur, a sail means affixed to said free-hanging pendulum capable of acting upon a vertically rising airflow with random lateral action to induce proportionate lateral motion to said striking means, a means of producing an airflow, a means to control the production of airflow, a means to support and align the elements, whereby, airflow is produced and delivered in an upward and vertical fashion to a sail, which acts in a random lateral motion to impel a pendulum striker, resulting in impacts with the resonating means to produce tones of random sequence and degree.

2. The resonating means of claim 1, wherein said resonating means include configurations of chimes for the production of tones.

3. The striking means of claim 1, wherein said striking means will include at least one striker along the vertical axis of a free hanging pendulum.

4. The sail means of claim 1, wherein said sail will be of a configuration capable of receiving an upward airflow and reacting with a random lateral motion and said sail being affixed to said vertical axis of said pendulum in such manner as to urge proportionate lateral movement of said striking means along vertical axis of said pendulum.

5. The means of producing an airflow of claim 1, wherein said means includes a fan to generate an airflow and said airflow exits in an upward and vertical fashion beneath the center rest position of said pendulum sail.

6. The means of control of the production of airflow of claim 1, wherein said means includes an electrical control to regulate electrical current to said fan.

7. The means of support and alignment of claim 1, wherein a body or framework supports and unifies the elements in a proper working relationship.

* * * * *